United States Patent [19]

Greenspan

[11] 4,429,800

[45] Feb. 7, 1984

[54] CHILD SAFE CONTAINER-CLOSURE UNIT

[76] Inventor: Donald J. Greenspan, 235 Pavilion Avenue, Riverside, N.J. 08075

[21] Appl. No.: 383,659

[22] Filed: Jun. 1, 1982

[51] Int. Cl.[3] ..... B65D 55/02

[52] U.S. Cl. ..... 215/216; 215/224

[58] Field of Search ..... 215/206, 209, 216, 224; 222/153; 206/1.5

[56] References Cited

U.S. PATENT DOCUMENTS

| | | | |
|---|---|---|---|
| 3,623,622 | 11/1971 | Sullivan . | |
| 3,669,295 | 6/1972 | Horvath . | |
| 3,684,116 | 8/1972 | Duffy . | |
| 3,704,802 | 12/1972 | Schultz . | |
| 3,826,394 | 7/1974 | Stull . | |
| 3,853,237 | 12/1974 | Marchant | 215/224 |
| 3,865,267 | 2/1975 | Morris | 215/206 |
| 4,036,385 | 7/1977 | Morris | 215/209 |
| 4,127,221 | 11/1978 | Vere | 222/153 |

*Primary Examiner*—George T. Hall

*Attorney, Agent, or Firm*—Panitch, Schwarze, Jacobs & Nadel

[57] ABSTRACT

A removable cover on a container has first and second tabs extending downwardly alongside the upper periphery of a container. Each tab has a latch member in contact with the lower surface of a ledge structure to prevent upward movement of the cover. The cover is removed by simultaneously pushing each tab radially inwardly and then pushing upwardly on the cover.

19 Claims, 17 Drawing Figures

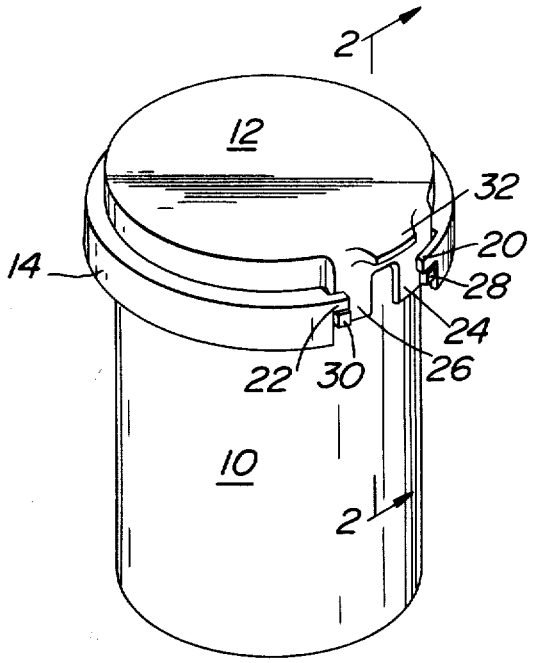
FIG. 1
FIG. 2
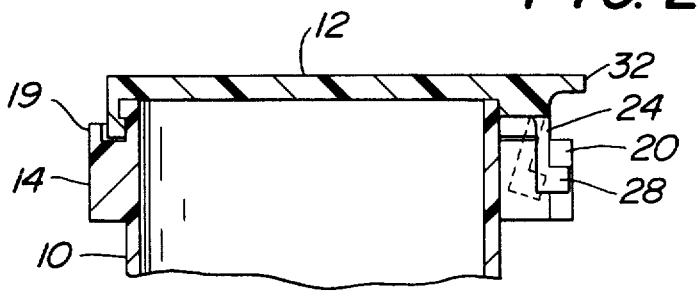
FIG. 3
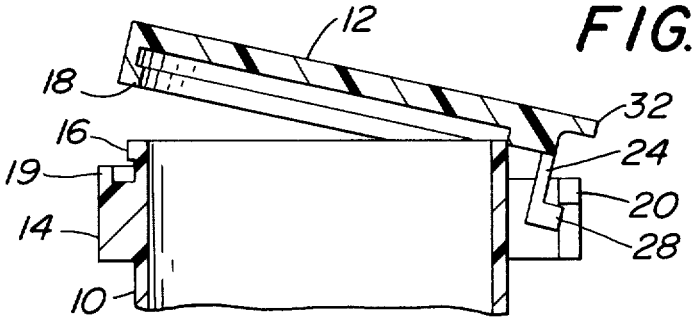

FIG. 14
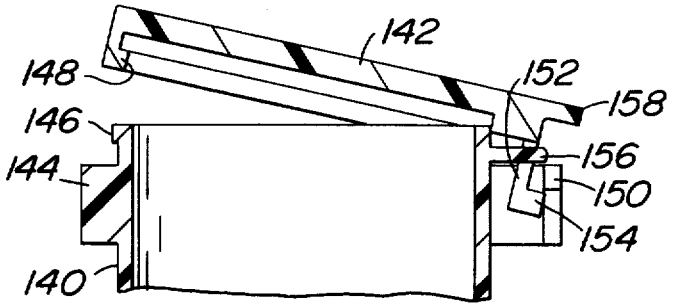
FIG. 16
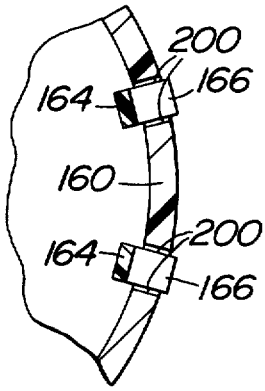
FIG. 15
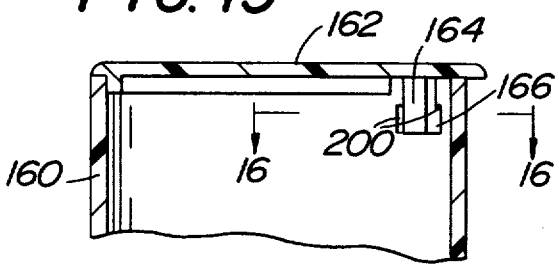
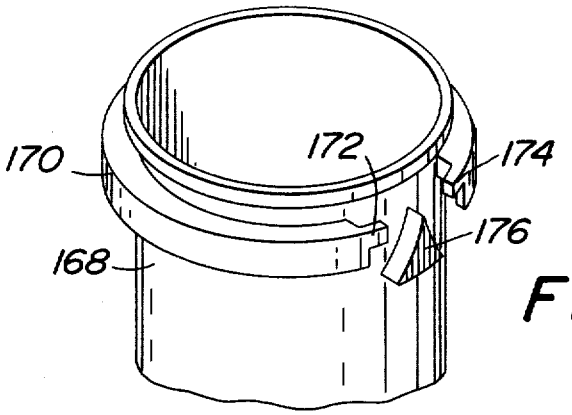
FIG. 17

CHILD SAFE CONTAINER-CLOSURE UNIT

BACKGROUND

A large number of child safe container-closure units have been suggested heretofore. In connection with containers for pills and capsules, it has been suggested to provide a cap which is threaded onto the container with removal of the cap requiring downward pressure simultaneously with twisting the cap. Children have difficulty removing the cap due to the requirement for simultaneous actions. Due to the plastic nature of the cap and container, and the difficulty in obtaining close tolerances, such caps have presented problems even for adults.

There is a need for a child safe container-closure unit which accomplishes the object of inhibiting access to the contents by a child, while at the same time facilitating access by an adult but in a manner which does not rely on threads, close tolerances, etc.

SUMMARY OF THE INVENTION

The present invention is directed to a child safe container-closure unit which includes a container for holding items. The container is capable of being opened at least at one end thereof. A releasable cover engages an opening at least at one end of the container. The cover has fastening means for attaching the cover to the container. The fastening means are releasable by an adult finger, but reasonably inoperable by at least one child's size finger.

In a preferred embodiment of this invention, the cover has tab means which extend downwardly alongside the periphery of the open end of the container. The tab means have latch means thereon to prevent upward movement of the cover. The tab means is sufficiently flexible such that the latch means may be deflected from a latched position to a release position by sufficient finger pressure on the tabs means. The tab means are designed to be operated by one adult size finger. The tab means are inoperative to release the latch means by at least one child's size finger. The tab means are also inoperative by two or more child size fingers.

Ledge means are preferably provided adjacent the periphery of the open end of the container. The latch means interlock with the ledge means when the cover is engaged with the container.

It is an object of the present invention to provide a novel child safe container-closure unit in the form of a container having a removable cover.

It is another object of the present invention to provide a child safe container-closure unit which is simple, inexpensive to manufacture, and reliable in preventing inadvertent access by the child without interfering with easy access by an adult.

Other objects and advantages will appear hereinafter.

BRIEF DESCRIPTION OF THE DRAWINGS

For the purpose of illustrating the invention, there is shown in the drawings forms which are presently preferred; it being understood, however, that this invention is not limited to the precise arrangements and instrumentalities shown.

FIG. 1 is a perspective view of a container-closure unit in accordance with the present invention.

FIG. 2 is a sectional view taken along the line 2—2 in FIG. 1.

FIG. 3 is a view similar to FIG. 2 but showing the cover being disengaged from the container.

FIG. 14 is a partial sectional view of a container-closure unit in accordance with another embodiment of the present invention.

FIG. 15 is a partial sectional view of a container-closure unit in accordance with another embodiment of the present invention.

FIG. 16 is a partial sectional view taken along the line 16—16 in FIG. 15.

FIG. 17 is a partial perspective view of a container for a container-closure unit in accordance with another embodiment of the subject invention.

DETAILED DESCRIPTION OF THE INVENTION

Figure 4:
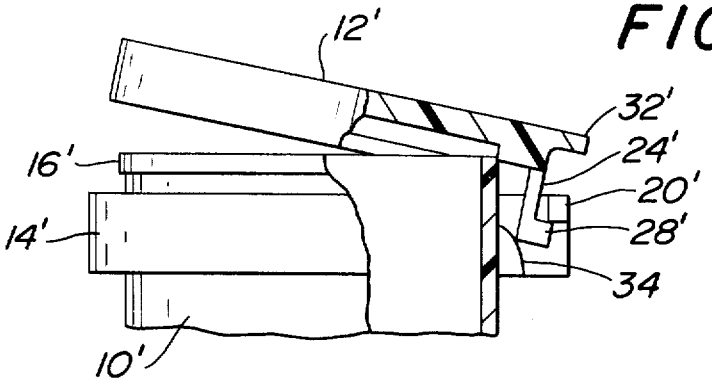
FIG. 4 is a view similar to FIG. 3 but showing another embodiment of the present invention.

The present invention takes advantage of the anatomical differences between the finger, i.e., thumb, sizes of adults and children. An adult's thumb has a side-to-side size of about ½ inch or more, whereas a child's thumb usually measures ⅜ inch or less. Generally, two fingers (two thumbs, thumb and another finger) of a child placed together will have a greater side-to-side size than an adult's thumb. Accordingly, the distance between the tabs of the container-closure unit of the present invention are such that they can accommodate only one adult size thumb for the simultaneous release of the latch members. The distance between the tabs being too large to allow for the simultaneous release of the latch members by a child's size thumb and too small to comfortably accommodate two or more child's size fingers.

Referring to the drawings in detail, wherein like numerals indicate like elements, there is shown in FIG. 1 a container 10 which for purposes of illustration is cylindrical and closed at its bottom end by way of an integral bottom wall. Container 10 may have other shapes in addition to being cylindrical. Container 10 is provided with a removable cover 12 which closes the upper end of the container 10. Although not shown in the drawings, the container 10 could have openings at both ends thereof with covers 12 for engagement therewith.

The container 10 is provided with a radially outwardly directed flange 14 spaced from but adjacent to a bead 16 at its upper end. Flange 14 is provided with an upstanding rim 19 formed integrally therewith. See FIGS. 2 and 3. Cover 12 has a lip 18 which snaps over the bead 16. Bead 16 is spaced from the upper surface of flange 14 by a sufficient distance so as to accommodate the lip 18. See FIG. 2. Rim 19 prevents use of a tool such as a screwdriver to pry up lip 18.

Ledge means 20 and 22 are provided on the flange 14. See FIGS. 1–3. Ledge means 20, 22 are spaced from one another by a gap in the flange 14 and a corresponding gap in the bead 16. Within said gap, there is provided a pair of tabs 24, 26. The tabs 24, 26 are integral in one piece at their upper end with the cover 12 and extend downwardly along the outer periphery of the upper portion of the container 10. The material of tabs 24, 26 is preferably resilient so as to spring back when pushed and then released. The tab 24 has a latch member 28 in contact with the bottom surface of the ledge means 20. Tab 26 has a latch member 30 in connection with a bottom surface on the ledge means 22. A thumb projection 32 extends radially outwardly from the periphery of the cover 12 in the zone of said gap and above the tabs 24, 26. Projection 32 extends beyond the periphery of flange 14. See FIG. 2. Projection 32 is preferable but not essential.

Access to the contents of the container 10 is attained as follows. The tabs 24 and 26 are spaced from one another by a sufficient distance so that a child will have difficulty bridging the distance with one thumb or other finger. The sharp edge on flange 14 interferes with application of pressure by a child using more than one finger (two thumbs, thumb and other finger, etc.). However, such distance does not interfere with the ability of an adult to bridge both tabs 24, 26 with one finger. The tabs 24, 26 are sufficiently flexible so that they may be flexed radially inwardly to the phantom position shown in FIG. 2. When each tab 24, 26 is flexed radially inwardly, the latch members 28, 30 are released. Thereafter, thumb pressure is applied upwardly against the projection 32 to raise the cover 12 in the area of the gap so that the latch members clear their respective ledge means. Thereafter, continued upward pressure on projection 32 unsnaps the lip 18 from the bead 16.

When replacing the cover 12, the tabs 24, 26 are first inserted into the space between the outer periphery of container 10 and the ledge means 20, 22. See FIG. 3. As soon as the projections 28, 30 are underneath their respective ledge means, cover 12 is then moved downwardly until the lip 18 is snapped over the bead 16.

In FIG. 4, there is illustrated another embodiment of the present invention which is identical with that described above except as will be made clear hereinafter. Accordingly, corresponding elements are identified by corresponding primed numerals. In FIG. 4, the outer periphery of the container 10' has a cam 34 in the gap between the ledge means 20' and 22' (the latter is not shown). The cam 34 is provided to facilitate the ease with which the cover 12' may be replaced on the container 10'. In FIG. 4, the cover 12' is shown being replaced. The tabs 24', 26' (the latter is not shown) are inserted until they contact the cam 34 and are then cammed radially outwardly. Cam 34 is desirable if the tabs are accidentally bent or lose flexibility due to repeated use.

Figure 5:
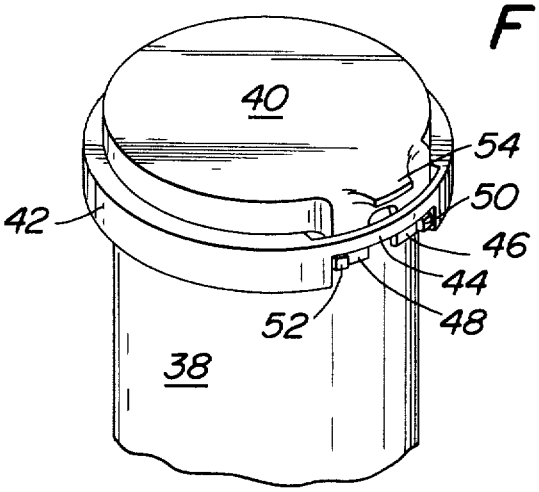
FIG. 5 is a partial perspective view of a container-closure unit in accordance with another embodiment of the present invention.

In FIG. 5, there is illustrated another embodiment of the present invention which is identical with that described above in connection with FIG. 1 except as will be made clear hereinafter. The container 38 has a removable cover 40. The container 38 also has a radially outwardly directed flange 42. A ledge means 44 is provided in the form of an arcuate band coaxial with the container 38 and spaced therefrom. Tabs 44, 46 are in said space and depend downwardly from the cover 40 alongside the periphery of the upper end portion of the container 38. Tab 46 has a latch member 50 in contact with the lower surface of band 44. Tab 48 has a latch member 52 in contact with a lower surface of the band 44. Cover 40 has a thumb projection 54 extending radially outwardly and at a location above the location of the tab 46, 48. Thus, it will be noted that the embodiment in FIG. 5 is the same as the embodiment in FIG. 1 except for the fact that only a single ledge means is provided instead of two spaced ledge means.

Figure 6:
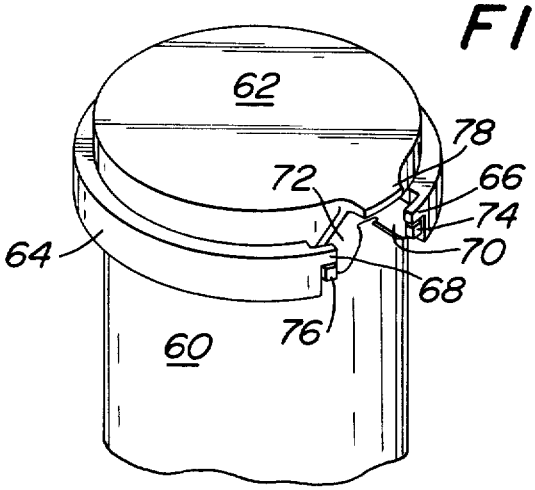
FIG. 6 is a partial perspective view of a container-closure unit in accordance with another embodiment of the present invention.

In FIG. 6, there is illustrated another embodiment of the present invention which is identical with that illustrated in FIG. 1 except as will be made clear herinafter. The container 60 has a removable cover 62. The container 60 also has a radially outwardly directed flange 64. Flange 64 terminates in spaced ledge means 66, 68 in the same manner as described above in connection with FIG. 1. Between the ledge means 66, 68 and the outer periphery of container 60, there is provided a pair of tabs 70, 72. The tabs 70, 72 are attached at their upper end to the cover 62 but extend downwardly and outwardly so as to be generally V-shaped. Tab 70 has a latch member 74 in contact with a lower surface on the ledge means 66. Tab 72 has a latch member 76 in contact with a lower surface on the ledge means 68. A thumb projection 78 extends radially outwardly from the cover 62 at a location above the location of the tabs 70, 72.

Figure 7:
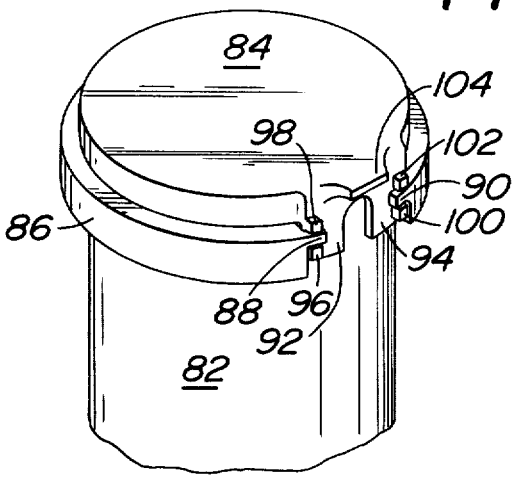
FIG. 7 is a partial perspective view of a container-closure unit in accordance with a further embodiment of the subject invention.

In FIG. 7, there is illustrated another embodiment of the subject invention which is similar with that illustrated in FIG. 1 except as will be made clear hereinafter. The container 82 has a removable cover 84. The container 82 also has a radially outwardly directed flange 86. Flange 86 terminates in spaced ledge means 88, 90 in the same manner as described in FIG. 1. Between ledge means 88, 90 and the outer periphery of container 82, there is provided a pair of tabs 92, 94. Tab 92 has a latch member 96 below ledge means 88 and a latch member 98 disposed below ledge means 88. Tab 94 has a latch member 100 located below ledge means 90 and a latch member 102 located above ledge means 90. The two pair of latch members 96, 98 for each tab 92, 94 provide a dual locking function. A thumb projection 104 extends radially outwardly from cover 84 at a location above the location of the tabs 92, 94.

Figure 8:
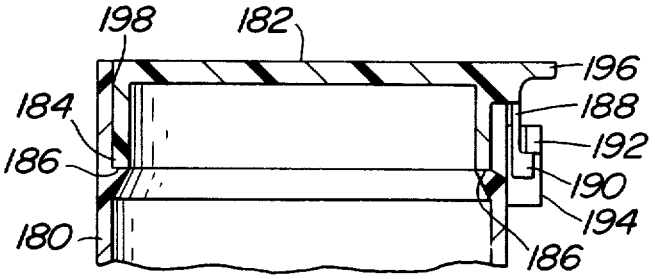
FIG. 8 is a partial sectional view of a container-closure unit in accordance with another embodiment of the present invention.
Figure 9:
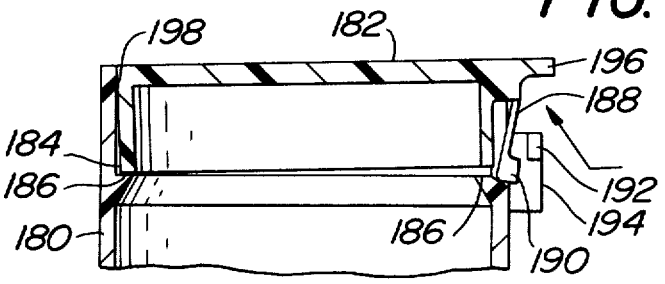
FIG. 9 is a view similar to FIG. 8 but showing the cover disengaged from the container.

FIGS. 8–9 illustrate another embodiment of the present invention. A cover 182 closes the opening 184 at one end of container 180. The cover 182 is inserted almost entirely within the container 180 and rests upon a shelf 186. A tab 188 extends downwardly from the top of the cover 182. The tab 188 is located outside the container 180. The tab 188 has a latch member 190 adjacent its bottom end thereof. The latch member 190 releasably engages ledge means 192 which is attached to a flange 194. The flange 194 and latch member 192 are located outside the container 180. A thumb projection 196 extends beyond the flange 194. The projection 196 is preferable, but not essential. The depth of the cover 182 would be shallow enough to allow enough room to pivot the cover 182 about the pivot point 198.

Figure 10:
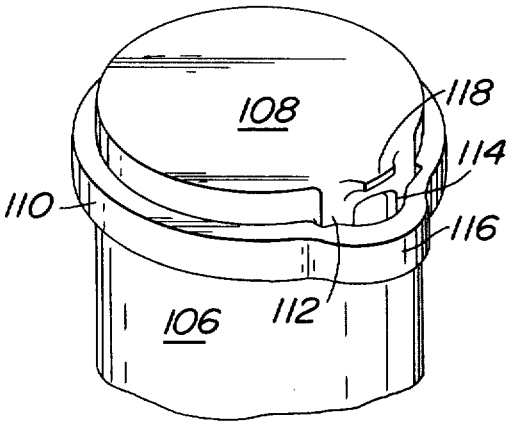
FIG. 10 is a partial perspective view of a container-closure unit in accordance with a further embodiment of the subject invention.

In FIG. 10, there is shown another embodiment of the present invention which is identical with that illustration in FIG. 1 except as will be made clear hereinafter. The container 106 has a removable cover 108. The container 106 also has a radially outwardly directed flange 110. Tabs 112 and 114 extend from the cover 108. A tunnel 116 is part of flange 110 but extends away from the container 106 at a sufficient distance to permit an adult size finger to disengage latch members (not shown) from ledge means (not shown).

Figure 11:
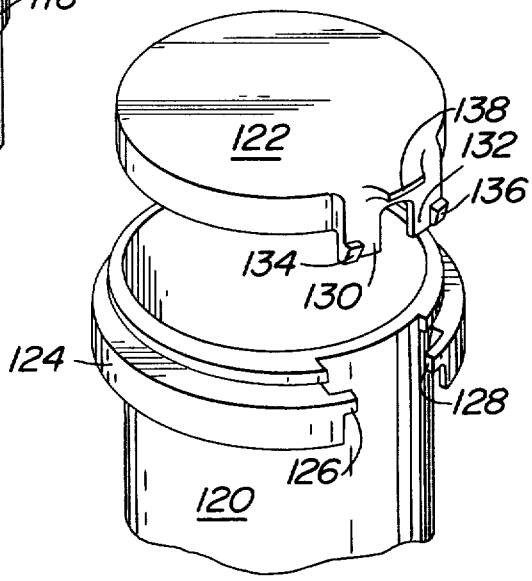
FIG. 11 is a partial perspective exploded view of a container-closure unit in accordance with still another embodiment of the present invention.
Figure 12:
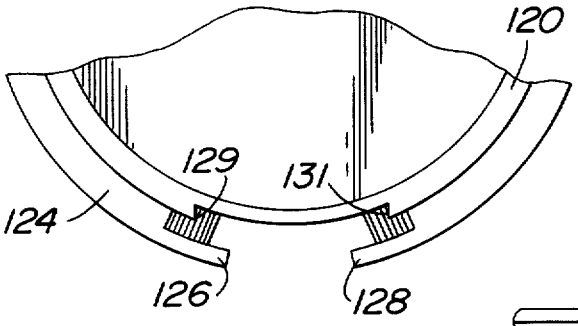
FIG. 12 is a top partial plan view of the container of the unit shown in FIG. 11, but with its cover disengaged.

In FIGS. 11–12, there is illustrated another embodiment of the present invention which is identical to that described above in connection with FIG. 1 except as will be made evident hereinafter. The container 120 has a removable cover 122. The container 120 also has a radially outwardly directed flange 124. Flange 124 terminates in spaced ledge means 126, 128. Between the ledge means 126, 128 and the outer periphery of the container 120, there is provided a pair of tabs 130, 132. The tabs 130, 132 each have latch members 134, 136 which engage with ledge means 126, 128. The latch members 134, 136 are tapered (cut at an angle) and the ledge means 126, 128 having a mating taper 129, 131 (see FIG. 12). Thumb projection 138 extends radially outwardly from cover 122.

Figure 13:
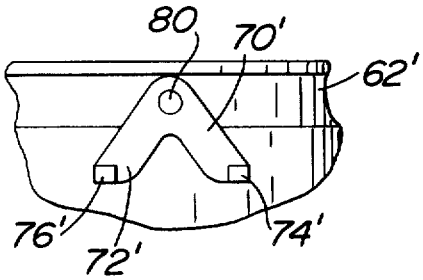
FIG. 13 is a side elevational view of the cover and tabs of another embodiment of the present invention.

In FIG. 13, there is illustrated another embodiment which is identical to that illustrated in FIG. 6 except as follows. The tabs 70', 72' are integral in one piece and joined to the cover 62' by pivot pin or rivet 80. Slight pivoting of the tabs 70', 72' is insufficient to effect a release of latch members 74', 76'. The very presence of a pivot may convince a child that release of the tabs is somehow related to the pivot. If only one tab is depressed radially and then pivoted, the depressed tab will contact a limit stop surface on the ledge means before the other tab has moved sufficiently to clear the ledge means.

In FIG. 14, there is illustrated another embodiment of the present invention which is identical to that described above in connection with FIGS. 1–3 except as will be made clear hereinafter. The container 140 has a removable cover 142. The container 140 also has a radially outwardly directed flange 144. Cover 142 has a lip 148 which snaps over the bead 146. Bead 146 is spaced from the upper surface of flange 144 by a sufficient distance so as to accommodate the lip 18. Ledge means 150 are provided on flange 144. Tab 152 is integral with the cover 142 and extends downwardly along the periphery of the container 140. Latch member 154 on tab 152 contacts the bottom surface of ledge means 22. A pin projection 156 extends outwardly from the container 140 parallel to cover 142 and disposed between ledge means 140 and cover 142. The pin projection 156 requires two-handed operation for disengaging the cover 142. A thumb projection 158 on cover 142 allows for easier disengagement of the cover 142 from the container 140.

In FIGS. 15–16, there is illustrated another embodiment of the subject invention which is similar to that described hereinafter in connection with FIGS. 1–3, except as will be made clear hereinafter. Container 160 has a removable cover 162. Tab 164 extends from cover 162 downwardly into the container 160 and parallel to the inside wall of the container 160. Latch member 166 extends perpendicularly from tab 164 through an aperture 200 in the wall of container 160 (see FIG. 16).

In FIG. 17, there is illustrated another embodiment of the container for the subject invention which is similar to that described hereinafter in connection with FIG. 1, except as will be made clear hereinafter. The container 168 is provided with a flange 170. Flange 170 terminates in ledge means 172, 174. Disposed adjacent the ledge means 172 and 174 is a triangular member 176 attached to the outside of container 168. This triangular member 176 prevents one's thumb from pushing up the cover (not shown) without having first to release the latch-ledge mechanism (not shown).

In each embodiment of the present invention, the tabs are spaced apart for a sufficient distance so that it would be difficult for a child to simultaneously deflect the tabs radially inwardly with a single finger. A suitable spacing is approximately $\frac{1}{4}$ to $\frac{1}{2}$ inch. An adult can easily deflect each tab radially inwardly and then push upwardly on the thumb projection to facilitate removal of the cover. The spacing of the tabs in combination with the necessity to simultaneously deflect each tab radially inwardly before applying upward pressure on the thumb projection renders the package a child safety package. The containers and covers are preferably made from a conventional polymeric plastic material. However, the containers may be made from other materials such as glass. It will be noted that the child safety package of this invention does not require close tolerances, is not limited to a container which is cylindrical, while being simple, inexpensive and reliable.

Other variations will be apparent to those skilled in the art. For example, the cover need not have a lip 18 but could have tabs disposed in bayonet slots whereby the cover is oscillated about the axis of the container to a release position after first pushing in on both tabs. If desired, the cover in whole or part could be hinged to pivot up after both tabs are released.

The present invention may be embodied in other specific forms without departing from the spirit or essential attributes thereof and, accordingly, reference should be made to the appended claims, rather than to the foregoing specification, as indicating the scope of the invention.

I claim:

1. A child safe container-closure unit comprising a container for holding items, said container capable of being opened at least at one end thereof, a releasable cover for engagement with an opening at least at one end of said container, said cover having fastening means for attaching said cover to said container, said fastening means including releasable latch means comprised of at least two latches separated by a predetermined distance so that the latch means is releasable by an adult finger, but is reasonably inoperable by at least one child's size finger.

2. A child safe container-closure unit comprising a container for holding items, said container capable of being opened at least at one end thereof, a releasable cover for engagement with an opening at least at one end of said container, said cover having tab means extending downwardly so as to extend alongside the periphery of the open end of said container when said cover is engaged with said container, said tab means having latch means thereon to prevent upward movement of said cover, said tab means being sufficiently flexible such that said latch means may be deflected from a latched position to a release position by sufficient finger pressure on said tab means, said tab means designed to be operated by one adult size finger and said tab means being reasonably inoperable to release said latch means by at least one child's size finger.

3. A child safe container-closure unit in accordance with claim 2 wherein said container further comprises ledge means disposed adjacent the periphery of the open end of said container and wherein said latch means interlock with said ledge means when said cover is engaged with said container.

4. A child safe container-closure unit in accordance with claim 2 wherein said tab means comprises first and second tabs.

5. A child safe container-closure unit in accordance with claim 2 wherein said cover has a lip which snaps over a bead at the upper end of the container, said container being free from said bead in the area of said tabs.

6. A child safe container-closure unit in accordance with claim 3 wherein said ledge means is defined by first and second circumferentially spaced projections.

7. A child safe container-closure unit in accordance with claim 3 wherein said ledge means is defined by an arcuate band spaced from and coaxial with said container.

8. A child safe container-closure unit in accordance with claim 4 wherein said tabs are angled downwardly and outwardly with respect to said cover so that included angle is of inverted V-shape.

9. A child safe container-closure unit in accordance with claim 2 including a cam on said container for camming the latch members radially outwardly when replacing the cover.

10. A child safe container-closure unit in accordance with claim 2 wherein a projection is provided on the cover at the location of said ledge means and tabs.

11. A child safe container-closure unit in accordance with claim 3 wherein said latch means comprise one or more latch members which contact the bottom surface of the ledge means.

12. A child safe container-closure unit in accordance with claim 11 wherein said latch members contact the top surface of the ledge means.

13. A child safe container-closure unit in accordance with claim 2 which further comprises a tunnel adjacent said latch means to accommodate only one adult size finger.

14. A child safe container-closure unit in accordance with claim 3 wherein said latch means and ledge means having mating tapers.

15. A child safe container-closure unit in accordance with claim 3 wherein a member is attached perpendicularly to said container and disposed between said cover and said ledge means to require two-handed operation of the unit.

16. A child safe container-closure unit in accordance with claim 2 wherein said latch means extends downwardly from said cover to be disposed within said container with said latch means being activated outside the container by virtue of an aperture in the wall of the container.

17. A child safe container-closure unit in accordance with claim 3 which further comprises a triangular member attached to said container and adjacent the ledge means so as to prevent disengagement of the cover from the container without having first to release the latch means.

18. A method of childproofing a container for holding items, said container capable of being opened at least at one end thereof comprising providing a releasable cover for engagement with an opening at least at one end of said container, providing said cover with fastening means for attaching said cover to said container, said fastening means including releasable latch means comprised of at least two latches separated by a predetermined distance so that the latch means is releasable by an adult size finger, but reasonably inoperable by at least one child's size finger.

19. A method of childproofing a container for holding items, said container capable of being opened at least at one end thereof, comprising:

providing a ledge means adjacent the periphery of the open end of said container, and providing a releasable cover for engagement with an opening at least at one end of said container, said cover having tab means extending downwardly so as to extend alongside the periphery of the open end of said container when said cover is engaged with said container, said tab means having latch means thereon, said latch means in contact with a surface of said ledge means when said cover is engaged with said container to prevent upward movement of said cover, said tab means being sufficiently flexible such that said latch means may be deflected from a latched position to a release position by sufficient finger pressure on said tab means, said tab means designed to be operated by one adult size finger and said tab means being reasonably inoperable to release said latch means by at least one child's size finger.

* * * * *